US011828523B2

(12) United States Patent
Thomas et al.

(10) Patent No.: US 11,828,523 B2
(45) Date of Patent: Nov. 28, 2023

(54) CONNECTOR FOR INCREASING HEAT TRANSFER BETWEEN A REFRIGERANT LOOP AND A REFRIGERATOR APPLIANCE CASING

(71) Applicant: Haier US Appliance Solutions, Inc., Wilmington, DE (US)

(72) Inventors: Ryan Thomas, Louisville, KY (US); Jeffrey Colyer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 62 days.

(21) Appl. No.: 17/508,276

(22) Filed: Oct. 22, 2021

(65) Prior Publication Data

US 2023/0130833 A1 Apr. 27, 2023

(51) Int. Cl.

| | |
|---|---|
| ***F25D 21/04*** | (2006.01) |
| ***F25D 11/02*** | (2006.01) |
| ***F25D 1/02*** | (2006.01) |

(52) U.S. Cl.

CPC ..... *F25D 21/04* (2013.01); *F25D 1/02* (2013.01); *F25D 2400/04* (2013.01)

(58) Field of Classification Search

CPC ..... F25D 21/04; F25D 11/02; F25D 2400/04

See application file for complete search history.

(56) References Cited

U.S. PATENT DOCUMENTS

| | | | | |
|---|---|---|---|---|
| 3,835,660 | A * | 9/1974 | Franck | F25D 23/082 62/277 |
| 4,735,062 | A | 4/1988 | Woolley | |
| 5,638,694 | A | 6/1997 | Nedo | |
| 6,036,294 | A * | 3/2000 | Banicevic | F25D 23/069 312/407 |
| 6,266,970 | B1 * | 7/2001 | Nam | F25D 23/028 62/277 |
| 6,428,130 | B1 | 8/2002 | Banicevic | |

FOREIGN PATENT DOCUMENTS

| | | |
|---|---|---|
| CN | 204063764 U | 12/2014 |
| CN | 112393487 A | 2/2021 |
| JP | 2006153377 A | 6/2006 |

* cited by examiner

*Primary Examiner* — Ana M Vazquez

(74) *Attorney, Agent, or Firm* — Dority & Manning, P.A.

(57) ABSTRACT

A refrigerator appliance includes a casing forming a receiving space, the casing defining a contact surface that contacts a door of the refrigerator appliance, and a sealed refrigerant system provided within the casing. The sealed refrigerant system includes a hot fluid portion positioned adjacent to the contact surface. The hot fluid portion includes a connector forming a planar heat transfer surface to transfer heat from the hot fluid portion to the contact surface.

20 Claims, 6 Drawing Sheets

CONNECTOR FOR INCREASING HEAT TRANSFER BETWEEN A REFRIGERANT LOOP AND A REFRIGERATOR APPLIANCE CASING

FIELD OF THE INVENTION

The present subject matter relates generally to refrigerator appliances, and more particularly to reducing condensation along an outer surface of a casing of a refrigerator appliance.

BACKGROUND OF THE INVENTION

Refrigerator appliances provide sealed spaces for keeping food, medicines, drinks, and other items at lower than ambient temperatures. Conventional refrigerator appliances include a casing forming one or more receiving chambers and one or more doors providing selective access to the one or more chambers. Moreover, conventional refrigerator appliances may utilize a refrigeration loop to cool a flow of air introduced to the one or more receiving chambers. The refrigeration loop may include a compressor, a condenser, an expansion device, and an evaporator. Hot or heated working fluid produced by the condenser may flow through at least a portion of the refrigeration loop, creating a warm section thereof.

In some environments, a humidity level of the ambient atmosphere coupled with the temperature difference between the one or more receiving chambers and the ambient atmosphere may result in condensation forming on a section of the casing to which the one or more doors contact to close off the one or more receiving chambers. Thus, preventing the formation of condensation is desirable. In at least one example, heat from the warm section of the refrigeration loop may be applied to the casing to prevent or eliminate moisture therefrom. However, current methods are expensive and relatively inefficient. Moreover, current methods and practices are inadequate in many situations, failing to prevent condensation.

Accordingly, a condensation prevention system that obviates one or more of the above-mentioned drawbacks would be helpful. In particular, a system for increasing heat transfer to the refrigerator appliance casing would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a casing defining a contact surface, the casing at least partially forming a receiving space therein; a door movable between an open position and a closed position, the door selectively abutting an outer face of the contact surface while in the closed position; a sealed system including at least a first tube section and a second tube section, wherein the first tube section and the second tube section are positioned adjacent the contact surface; and a thermally conductive connector provided around the first tube section and the second tube section collectively, the thermally conductive connector adjoining the first tube section to the second tube section and forming a planar contact area abutting an inner face of the contact surface.

In another exemplary aspect of the present disclosure, a refrigerator appliance is provided. The refrigerator appliance may include a casing defining a contact surface, the casing at least partially forming a receiving space therein; a door movable between an open position and a closed position, the door selectively abutting an outer face of the contact surface while in the closed position; a sealed refrigerating system provided within the receiving space of the casing, the sealed refrigerating system including a hot fluid portion positioned adjacent the contact surface, wherein the hot fluid portion comprises a first tube section and a second tube section parallel to the first tube section; and a thermally conductive fin provided around the first tube section and the second tube section, the thermally conductive fin comprising a first fin and a second fin sandwiched around the first tube section and the second tube section and forming a planar contact area abutting an inner face of the contact surface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
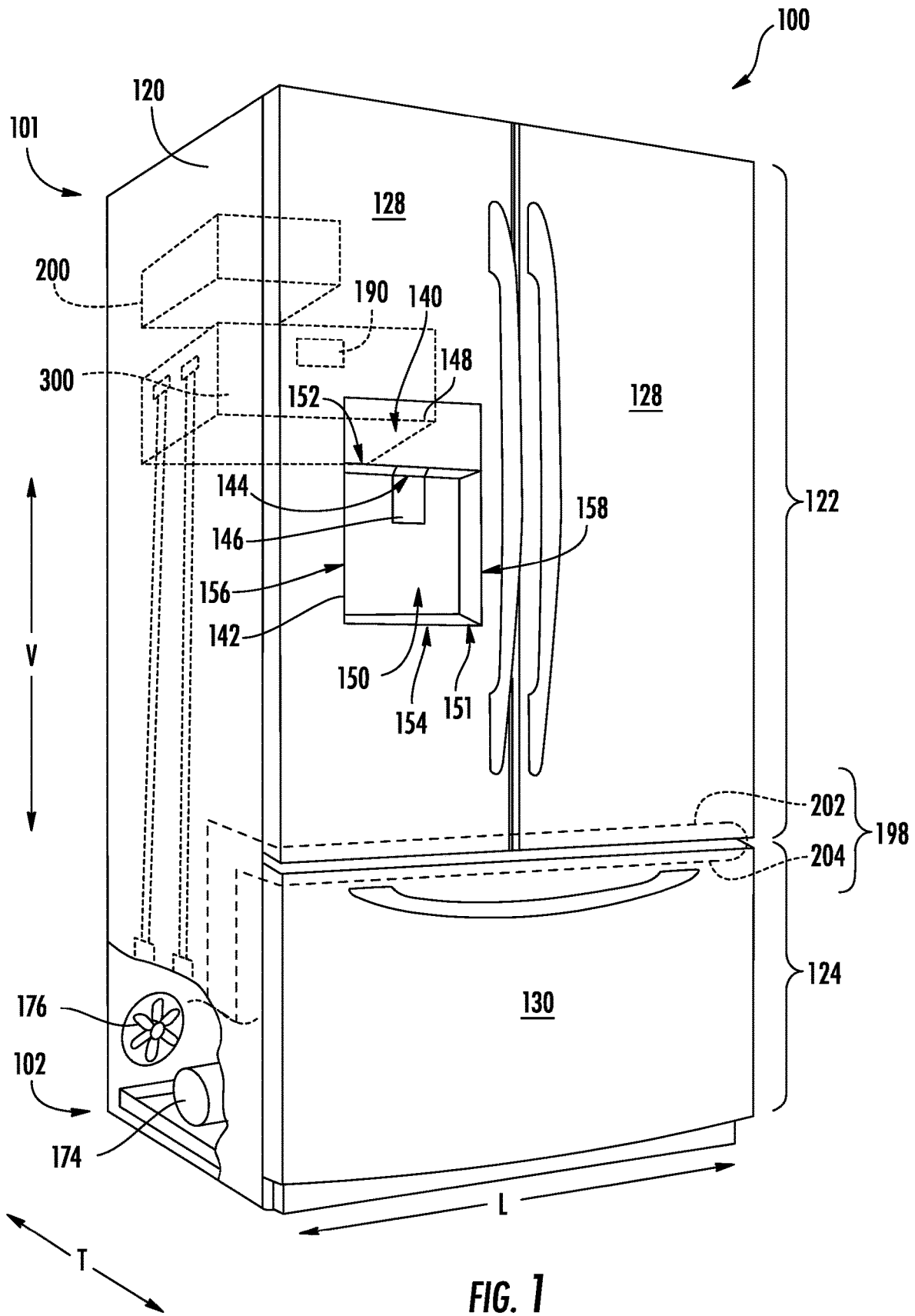
FIG. 1 provides a perspective view of a refrigerator appliance according to an exemplary embodiment of the present disclosure, wherein refrigerator doors are shown in a closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Referring now to the drawings, FIG. 1 provides a front view of an exemplary refrigerator appliance 100 according to at least one embodiment of the present disclosure. Refrigerator appliance 100 may include a pair of refrigerator doors 128 (shown in a closed position in FIG. 1). Refrigerator appliance 100 includes a cabinet or casing 120 that extends between a top 101 and a bottom 102 along a vertical direction V. Casing 120 also extends along a lateral direction L and a transverse direction T, each of the vertical direction V, lateral direction L, and transverse direction T being mutually perpendicular to one another. Casing 120 may define one or more chilled chambers for receipt of food items for storage. In some embodiments, casing 120 defines a fresh food chamber or compartment 122 positioned at or adjacent top 101 of casing 120 and a freezer chamber or compartment 124 arranged at or adjacent bottom 102 of casing 120. As such, refrigerator appliance 100 is generally referred to as a bottom mount refrigerator. It is recognized, however, that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular refrigerator chamber configuration.

Moreover, casing 120 may at least partially define a receiving space therein 126, the receiving space 126 being separate from the chilled chambers. For instance, as will be described in more detail below, a sealed system (sealed refrigerant system 400) may be provided within refrigerator appliance 100 to supply cool a flow of air to be supplied to the chilled chambers. This sealed system may be isolated from the chilled chambers, e.g., by at least one wall of casing 120. As will be shown and described in more detail with respect to FIG. 3, the sealed system may be provided within receiving space 126 at least partially formed by casing 120. Accordingly, elements of the sealed system may be separated from the chilled chambers.

Further, at least one mullion 132 may be formed between fresh food chamber 122 and freezer chamber 124. Mullion 132 may fluidly separate fresh food chamber 122 from freezer chamber 124. Mullion 132 may be formed at least partially by casing 120. In at least one example, as shown in the figures, mullion 132 is arranged horizontally (e.g., extending along the lateral direction L and the transverse direction T). Mullion 132 may partially define receiving space 126 therein. In detail, at least part of the sealed system may be provided within mullion 132. Additionally or alternatively, mullion 132 may define a contact surface 129 to which doors 128 and 130 may selectively adhere to seal the chilled chambers. For instance, contact surface 129 may include an inner face 1291 and an outer face 1292, such that doors 128 and 130 selectively contact outer face 1292 of contact surface 129. Thus, contact surface 129 may be defined along the vertical direction V and the lateral direction L. In at least some embodiments, contact surface 129 is defined around an entire perimeter of each of the chilled chambers.

Refrigerator doors 128 may be rotatably hinged to an edge of cabinet 120 for selectively accessing fresh food chamber 122. In some embodiments, a freezer door 130 is arranged below refrigerator doors 128 for selectively accessing freezer compartment 124. Freezer door 130 may be coupled to a freezer drawer (not shown) slidably mounted within freezer compartment 124. Refrigerator doors 128 and freezer door 130 are shown in the closed configuration in FIG. 1.

In some embodiments, refrigerator appliance 100 includes a dispensing assembly 140 for dispensing liquid water or ice. Dispensing assembly 140 includes a dispenser 142 positioned on or mounted to an exterior portion of refrigerator appliance 100 (e.g., on one of doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, another suitable actuator may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150, as will be described in greater detail below. Generally, dispenser recess 150 defines a transverse opening 151 that extends in the vertical direction V from a top recess end 152 to a bottom recess end 154, as well as in the lateral direction L from a first recess side 156 to a second recess side 158. In certain embodiments, dispenser recess 150 is positioned at a predetermined elevation convenient for a user to access ice or water and enabling the user to access ice without the need to bend-over and without the need to open doors 128. In optional embodiments, dispenser recess 150 is positioned at a level that approximates the chest level of a user.

Generally, operation of the refrigerator appliance 100 can be regulated by a controller 190 that is operatively coupled to user interface panel 148 or various other components, as will be described below. User interface panel 148 provides selections for user manipulation of the operation of refrigerator appliance 100, such as selections between whole or crushed ice, chilled water, or other various options. In response to user manipulation of user interface panel 148 or one or more sensor signals, controller 190 may operate various components of the refrigerator appliance 100. Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor (e.g., using a combination of discrete analog or digital logic circuitry—such as switches, amplifiers, integrators, comparators, flip-flops, AND gates, and the like) to perform control functionality instead of relying upon software.

Controller 190 may be positioned in a variety of locations throughout refrigerator appliance 100. In the illustrated embodiment, controller 190 is located adjacent to or on user interface panel 148. In other embodiments, controller 190 may be positioned at another suitable location within refrigerator appliance 100, such as for example within a fresh food chamber, a freezer door, etc. Input/output ("I/O") signals may be routed between controller 190 and various operational components of refrigerator appliance 100. For example, user interface panel 148 may be in operable communication (e.g., electrical communication) with controller 190 via one or more signal lines or shared communication busses.

Figure 2:
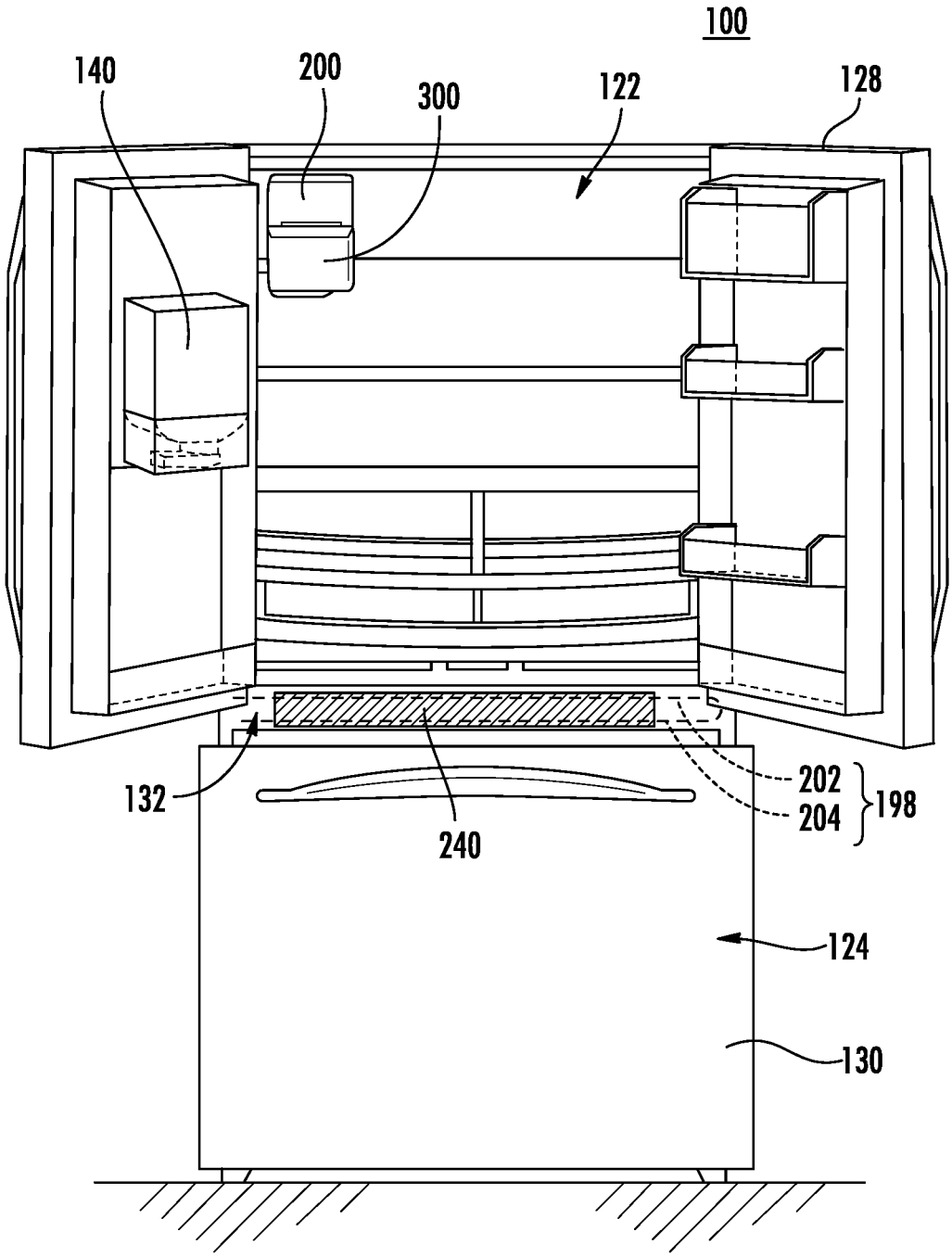
FIG. 2 provides a front view of the exemplary refrigerator appliance of FIG. 1, where in refrigerator doors are shown in an open position.

FIG. 2 is a perspective view of refrigerator appliance 100 having refrigerator doors 128 in an open position to reveal the interior of the fresh food chamber 122. Refrigerator appliance 100 may include an ice making assembly or icemaker 200, and an ice storage compartment 300. Icemaker 200 may be provided within the fresh food chamber 122 and may be ambiently exposed within the fresh food chamber. In other words, icemaker 200 is not insulated from ambient air within the fresh food chamber 122. Icemaker 200 may be in any suitable location within fresh food compartment 122 such that ice may be formed and moved into ice storage compartment 300. In one example, icemaker 200 is located in an upper left corner of fresh food compartment 122 when viewed from a front of refrigerator appliance 100. As is understood, icemaker 200 may be used within any suitable refrigerator appliance, such as refrigerator appliance 100.

Figure 3:
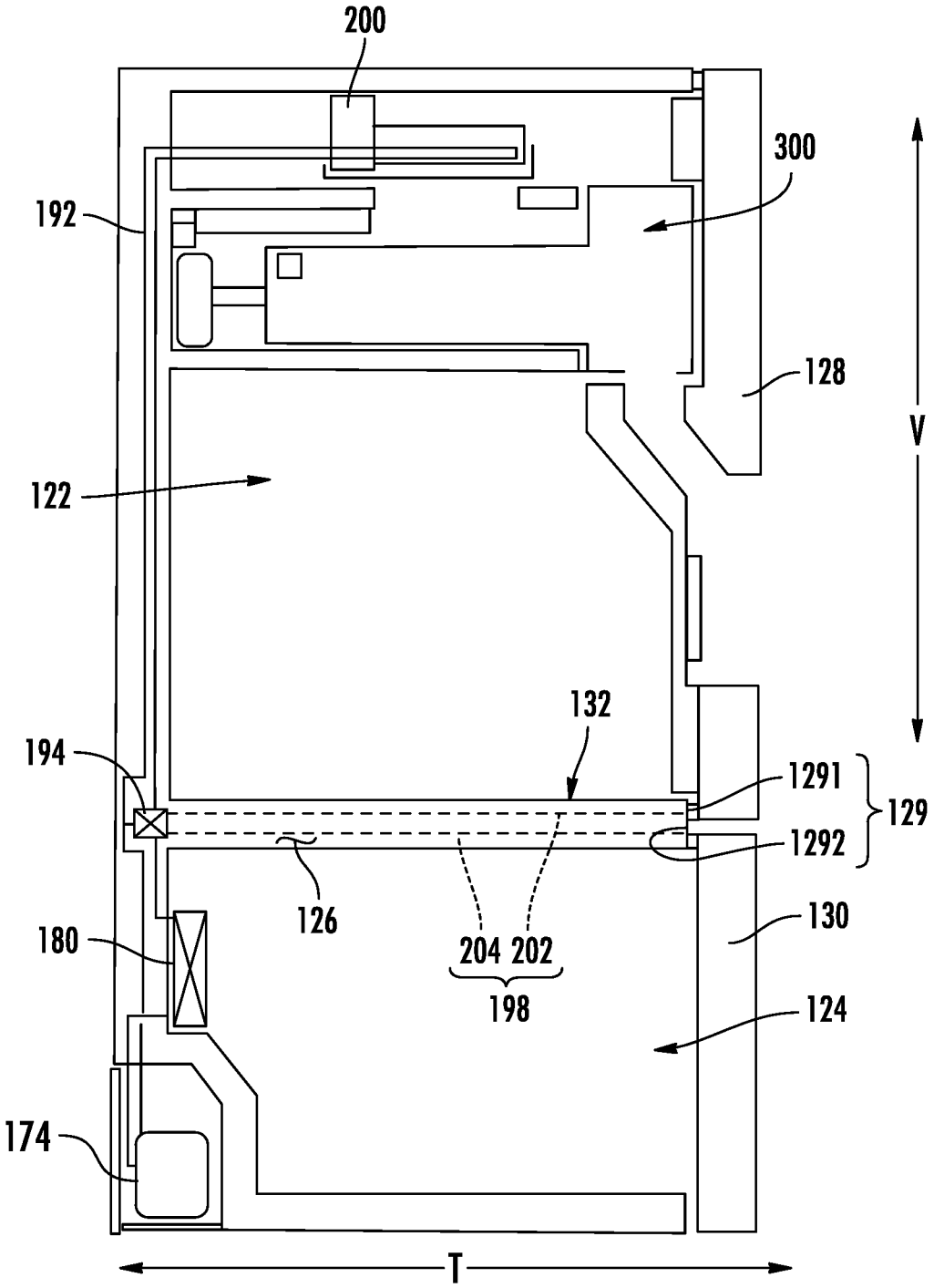
FIG. 3 provides a side cross-sectional view of the exemplary refrigerator appliance of FIG. 1.
Figure 4:
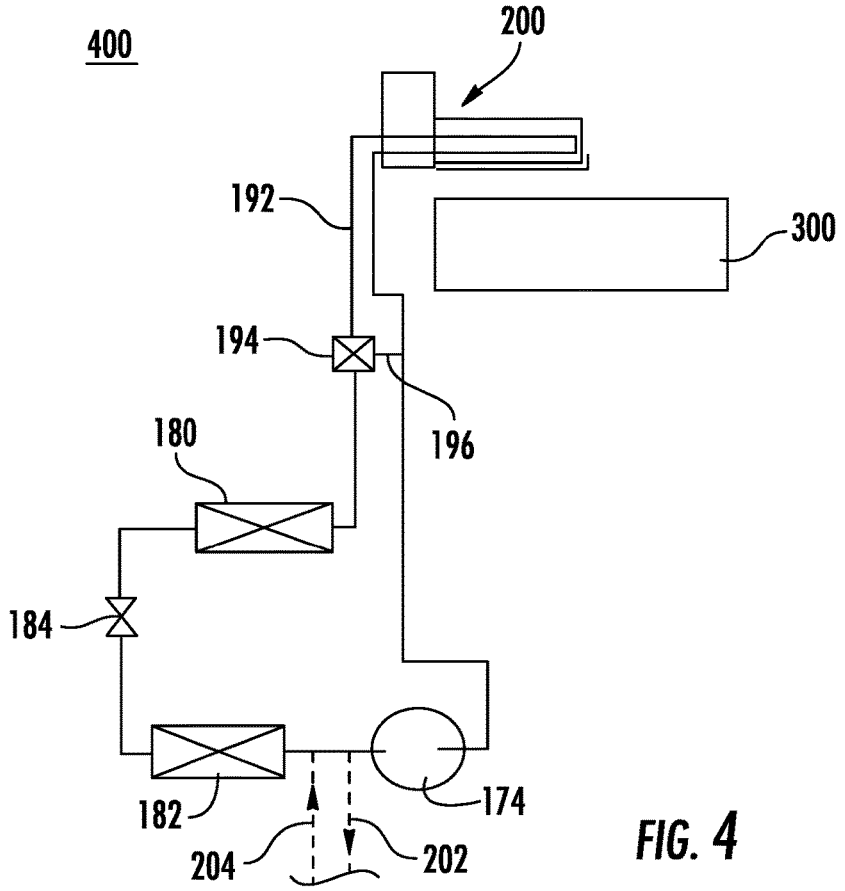
FIG. 4 provides a schematic view of a sealed refrigerant system according to the exemplary refrigerator appliance of FIG. 1.

FIG. 3 is a cut away side view of an exemplary refrigerator appliance 100, and FIG. 4 illustrates a schematic view of a sealed refrigerant system 400 that is generally configured for executing a vapor compression cycle. As seen in FIGS. 3 and 4, refrigerator appliance 100 may include a cooling system for maintaining a suitable temperature within each of fresh food compartment 122, freezer compartment 124, and ice storage compartment 300. For example, according to an exemplary embodiment of the refrigerator appliance 100, the freezer compartment 124 may be provided below the fresh food compartment 122. The cooling system may include a sealed refrigerant system, or sealed system 400, which may circulate a refrigerant via a refrigerating conduit 192. Sealed system 400 may circulate the refrigerant throughout refrigerator appliance 100. As described above, sealed system 400 may be at least partially provided within receiving space 126 formed by casing 120. In detail, refrigerant conduit 192 may follow a serpentine path through receiving space 126.

The sealed system may include a compressor 174, a condenser 182, an expansion device 184, and an evaporator 180. Each of the compressor 174, condenser 182, expansion device 184, and evaporator 180 may be fluidly connected to one another by the refrigerating conduit or first refrigerating conduit 192. The evaporator 180 may be provided in the freezer compartment 124 and may be configured to cool air within the freezer compartment 124.

Within sealed system 400, gaseous refrigerant flows into compressor 174, which operates to increase the pressure of the refrigerant. This compression of the refrigerant raises its temperature, which is lowered by passing the gaseous refrigerant through condenser 182. Within condenser 182, heat exchange with ambient air takes place so as to cool the refrigerant and cause the refrigerant to condense to a liquid state. The heat exchange may be enhanced by a condenser fan 176 (FIG. 1).

Prior to the refrigerant passing through condenser 182, the refrigerant may be directed through a hot gas (or working fluid) portion 198. In detail, hot fluid portion 198 may be provided within mullion 132. Hot fluid portion 198 may include a path through which the heated refrigerant from compressor 174 flows before being cooled in condenser 182. Hot fluid portion 198 may include a first tube section 202 and a second tube section. For instance, with reference to FIG. 5, first tube section 202 and second tube section 204 may be connected to each other such that the refrigerant (e.g., heated refrigerant) flows from compressor 174 into first tube section 202 and subsequently into second tube section 204 before entering condenser 182. In at least some embodiments, each of first tube section 202 and second tube section 204 are provided adjacent to contact surface 129 of mullion 132.

Figure 5:
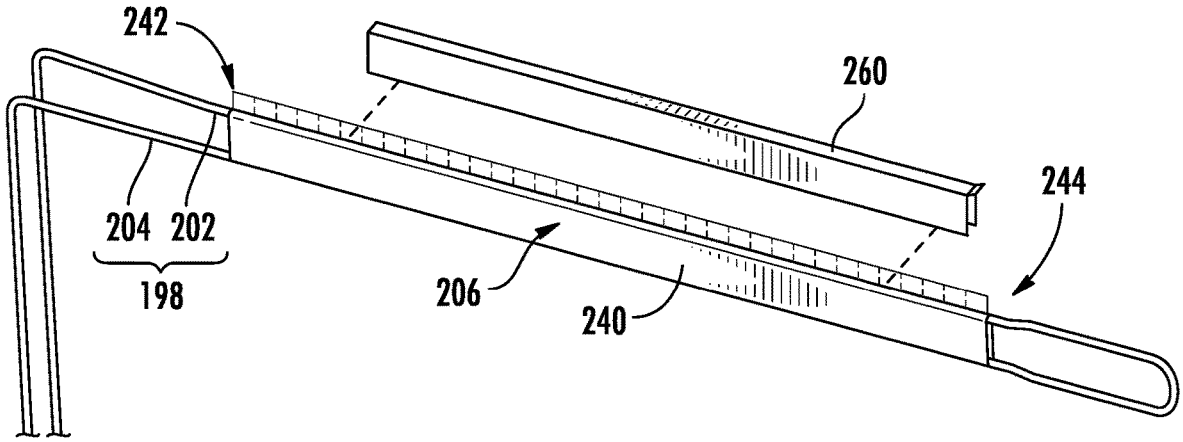
FIG. 5 provides a perspective view of an exemplary thermally conductive connector around part of the sealed refrigerant system of FIG. 4.

For instance, hot fluid portion 198 of refrigerating conduit 192 may be provided within mullion 132. First tube section 202 may extend from a rear of refrigerator appliance 100 toward a front of refrigerator appliance 100 through mullion 132 (e.g., along the transverse direction T). In some embodiments, first tube section 202 extends from the bottom 102 of refrigerator appliance 100 along the vertical direction V toward mullion 132. Referring briefly to FIG. 5, at or near the front of refrigerator appliance 100, first tube section 202 may bend (e.g., about 90°) and extend along the lateral direction L from a first side to a second side of refrigerator appliance 100. At this point, first tube section 202 may be adjacent to contact surface 129. At or near the second side of refrigerator appliance, hot fluid portion 198 may bend, e.g., approximately 180° (e.g., along the vertical direction V). At this point, second tube section 204 is defined. Second tube section 204 may then extend along the lateral direction L toward the first side of refrigerator appliance 100. Similar to first tube section 202, second tube section 204 may be adjacent to contact surface 129. Accordingly, first tube section 202 and second tube section 204 may be arranged vertically with respect to one another. For instance, first tube section 202 may be arranged below second tube section 204 along the vertical direction V (or vice versa). Thus, first tube section 202 may be predominantly parallel with second tube section 204. The refrigerant, having passed through hot fluid portion 198, may then proceed to condenser 182 to be further cooled.

Expansion device 184 (e.g., a mechanical valve, capillary tube, electronic expansion valve, or other restriction device) receives liquid refrigerant from condenser 182. From expansion device 184, the liquid refrigerant enters evaporator 180. Upon exiting expansion device 184 and entering evaporator 180, the liquid refrigerant drops in pressure and vaporizes. Due to the pressure drop and phase change of the refrigerant, evaporator 180 is cool relative to freezer compartment 124. As such, cooled water and ice or air is produced and refrigerates icemaker 200 or freezer compartment 124. Thus, evaporator 180 is a heat exchanger which transfers heat from water or air in thermal communication with evaporator 180 to refrigerant flowing through evaporator 180.

The sealed refrigerant system 400 may include a three-way valve 194 operably coupled to the refrigerant conduit 192 between the evaporator 180 and the icemaker 200. The three-way valve 194 may be selectively opened to allow refrigerant to circulate through the icemaker 200. The controller 190 may control an opening and closing of the three-way valve 194 to allow the refrigerant to circulate through the icemaker 200. The three-way valve 194 may be any suitable valve capable of selectively opening and closing a bypass passageway 196. For example, the three-way valve 194 may have one inlet and two outlets, and the controller 190 may control one outlet to be open at a time. As such, refrigerant may either circulate through the refrigerant conduit 192 or through the bypass passageway 196.

As described above, hot fluid portion 198 may be provided adjacent to contact surface 129 of mullion 132. It should be noted that hot fluid portion 198 may extend to more or fewer places within receiving space 126 of casing 120. For instance, in some embodiments, contact surface 129 may be defined as any portion of casing 120 where either refrigerator doors 128 or freezer door 130 (or gaskets thereof) contact when in a closed position. However, hot fluid portion 198 will be described herein with reference to contact surface 129 of mullion 132.

Sealed refrigerant system 400 may include one or more connectors 240 provided around hot fluid portion 198. For purposes of this disclosure, a single connector 240 will be described in detail. Hereinafter, connector 240 may be referred to as a thermally conductive connector, a fin, a tape, or a clip. It should be noted that connector 240 may take any suitable form to provide a connection between first tube section 202 and second tube section 204 to transfer heat therefrom. Various embodiments will be described herein. Connector 240 may be a thermally conducting connector, having high heat transfer and thermal conducting properties. For instance, connector 240 may be aluminum or copper. Connector 240 may selectively provide a connection between first tube section 202 and second tube section 204.

For instance, as best seen in FIG. 5, connector 240 may wrap around first tube section 202 and second tube section 204 together, thereby creating a planar section, or planar contact area 206 between first tube section 202 and second tube section 204 capable of transferring heat. Connector 240 may thus be vertically oriented (e.g., defining planar contact area 206 in the vertical direction V and the lateral direction L). Thus, planar contact area 206 may be predominantly parallel with contact surface 129 of mullion 132. Connector 240 may extend along the lateral direction L for a predetermined length of hot fluid portion 198. In some embodiments, connector 240 extends between about 50% and about 75% of a total length of hot fluid portion 198 (e.g., first tube section 202 and second tube section 204).

According to at least one embodiment of the present disclosure, connector 240 is formed from a thermally conductive tape. For instance, connector 240 may include a metallic tape wrapped around first tube section 202 and second tube section 204 together. As seen in FIG. 5, the metallic tape may join first tube section 202 to second tube section 204, e.g., along the vertical direction V. A gap may be formed between first tube section 202 and second tube section 204 (e.g., along the vertical direction V), such that connector 240 forms planar contact area 206 adjacent to contact surface 129 of mullion 132. Advantageously, heat from the hot gas flowing through first tube section 202 and second tube section 204 may be transferred to connector 240 (e.g., in this case, the metallic tape) and subsequently transferred to contact surface 129 of mullion 132. In detail, planar contact area 206 may abut an inner face 1291 of contact surface 129 (e.g., within receiving space 126).

The metallic tape may be, for example, an aluminum tape. Therefore, connector 240 may be formed from aluminum to transfer heat more effectively from hot fluid portion 198 to contact surface 129 (e.g., inner face 1291 of contact surface 129). The metallic tape may be wrapped continuously along hot fluid portion 198 along the lateral direction L. For instance. the metallic tape may be applied to both first tube section 202 and second tube section 204 together in a spiral manner from a first end 242 of connector 240 to a second end 244 of connector 240. Thus, a full lateral length of connector 240 may be ensured (e.g., provided with the metallic tape) to increase thermal conduction to inner face 1291 of contact surface 129.

In another embodiment, connector 240 may be composed of two strips of metallic tape. For instance, connector 240 may form a fin around first tube section 202 and second tube section 204. A first side of the fin (e.g., connector 240) may be a first strip of the metallic tape (e.g., extending along the lateral direction L). The first side of the fin may be provided on a rear side of hot fluid portion 198 (e.g., away from inner face 1291 of contact surface 129). In detail, the first side of the fin (or a first fin) may be a first strip of the metallic tape contacting a rear (e.g., along the transverse direction T) side of each of first tube section 202 and second tube section 204. The first fin may extend from the first end 242 to the second end 244. Similarly, the second side of the fin may be provided on a front side of hot fluid portion 198 (e.g., toward inner face 1291 of contact surface 129). In detail, the second side of the fin (or a second fin) may be a second strip of the metallic tape contacting a front (e.g., along the transverse direction T) side of each of first tube section 202 and second tube section 204. The second fin may extend from the first end 242 to the second end 244. Thus, the first fin may be adhered to the second fin having hot fluid portion 198 (e.g., both first tube section 202 and second tube section 204) sandwiched in between.

Figure 6:
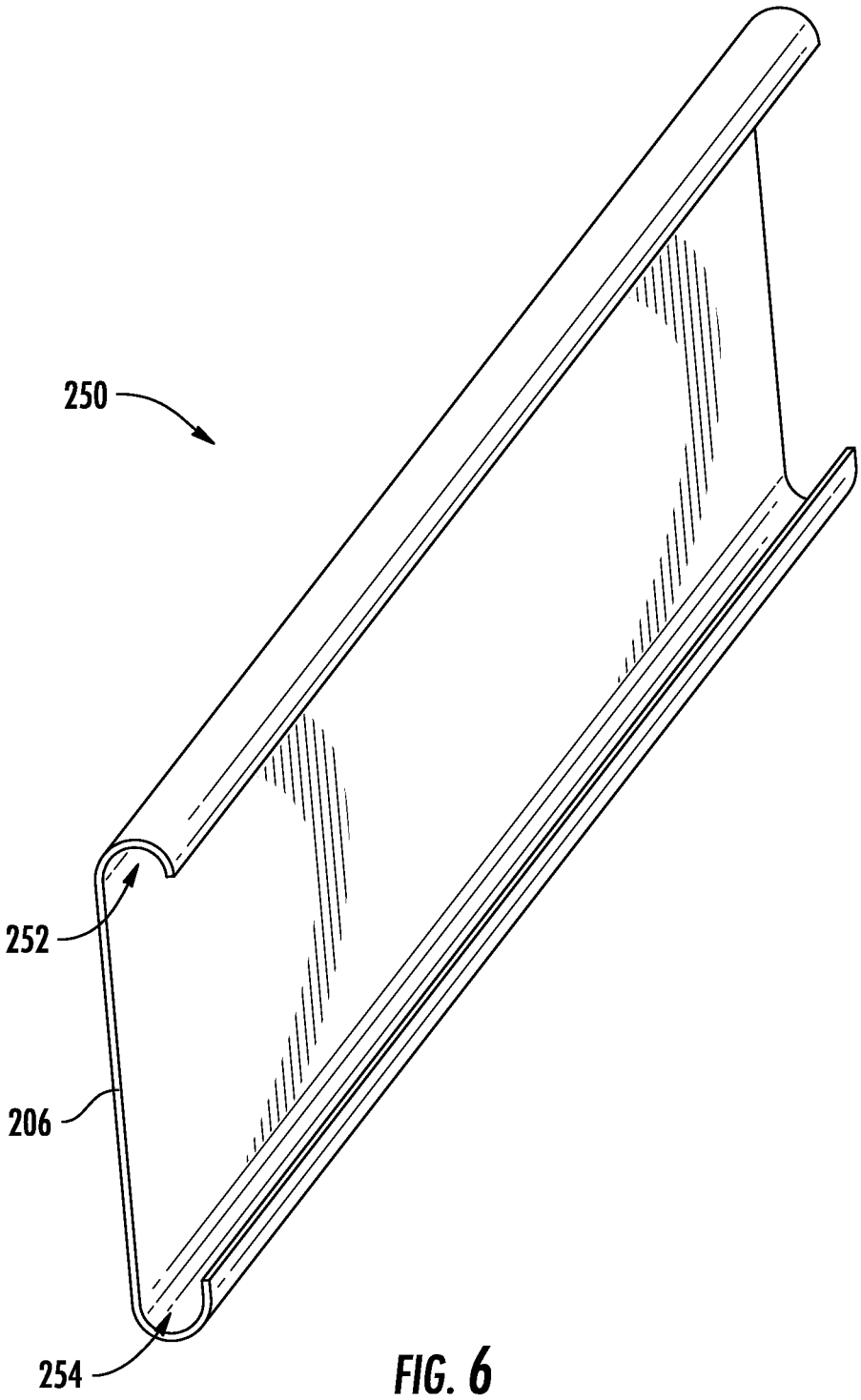
FIG. 6 provides a perspective view of another exemplary thermally conductive connector.
Figure 7:
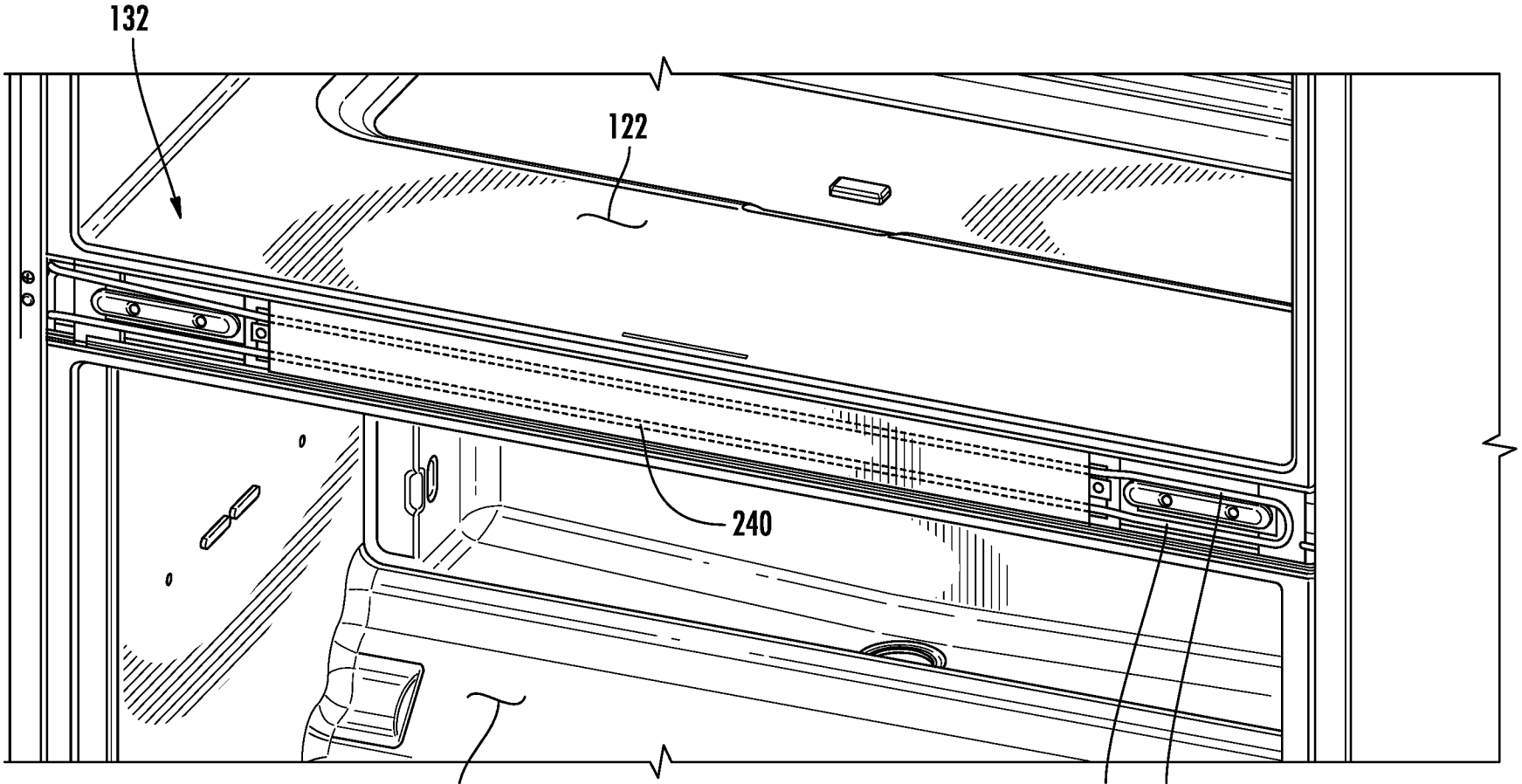
FIG. 7 provides a perspective view of a portion of the sealed refrigerant system of FIG. 4 including an exemplary thermally conductive connector in an installed position.

According to another embodiment of the present disclosure, connector 240 may include a clip 250. For instance, connector 240 may be clip 250, as shown in FIG. 6. Clip 250 may provide a thermal and physical connection between first tube section 202 and second tube section 204. Accordingly, clip 250 may form planar contact area 206 between first tube section 202 and second tube section 204. Moreover, clip 250 may have a first hooked edge 252 and a second hooked edge 254 opposite the first hooked edge 252 (e.g., along the vertical direction V). For instance, first hooked edge 252 may selectively hook onto first tube section 202. In detail, first hooked edge 252 may be bent from planar contact area 206 to fit over first tube section 202. First hooked edge 252 may have a radius of curvature that is equal to a radius of curvature of first tube section 202. Accordingly, first hooked edge 252 may contact first tube section 202 over at least half of a circumference of first tube section 202 and across an entire lateral length of clip 250 (e.g., connector 240).

Similarly, second hooked edge 254 may selectively hook onto second tube section 204. In detail, second hooked edge 254 may be bent from planar contact area 206 to fit over second tube section 204. Second hooked edge 254 may have a radius of curvature that is equal to a radius of curvature of second tube section 204. Accordingly, second hooked edge 254 may contact second tube section 204 over at least half of a circumference of second tube section 204 and across an entire lateral length of clip 250 (e.g., connector 240). Advantageously, the heat transfer between hot gas portion 198 (e.g., first tube section 202 and second tube section 204) and clip 250 may be maximized throughout an entire length and radius of curvature of each of first hooked edge 252 and second hooked edge 254. Additionally or alternatively, clip 250 may be formed from a metallic, thermally conductive material. In at least some embodiments, clip 250 is formed from aluminum.

Refrigerator appliance 100 may further include a spacer 260. Spacer 260 may be provided within mullion 132. In detail, spacer 260 may be provided within receiving space 126 at least partially defined by casing 120. Spacer 260 may be located adjacent to connector 240, e.g., along the transverse direction T. For instance, spacer 260 may be provided behind connector 240 (e.g., along the transverse direction T) away from inner face 1291 of contact surface 129. Accordingly, spacer 260 may bias connector 240 toward inner face 1291 of contact surface 129. Advantageously, thermally conductive connector 240 may maintain contact with inner face 1291 of contact surface 129, ensuring proper heat transfer from hot fluid portion 198 to contact surface 129, eliminating condensation and moisture formation thereon.

Spacer 260 may be a single spacer 260, or may include several spacers 260 spaced apart from each other along the lateral direction L. Moreover, spacer 260 may be formed from a foam material. In detail, spacer 260 may include one or more resilient materials capable of maintaining pressure against connector 240, e.g., along the transverse direction T. In some embodiments, spacer 260 contains one or more insulating materials. Thus, the heat from hot fluid portion 198 may be directed more efficiently toward connector 240, and subsequently to inner face 1291 of contact surface 129.

According to the described embodiments, a sealed refrigerant system within a refrigerator appliance may include a hot gas portion containing relatively heated gas from a compressor. The hot gas portion may be located at or near a contact surface of a casing of the refrigerator appliance, such as where a door of the refrigerator appliance contacts and seals one or more chilled chambers thereof. The hot gas portion may include two or more tube sections through which the heated gas flows, forming a loop thereof. The refrigerator appliance may include a connector that connects each of the two or more tube sections together, forming a planar contact area having a larger surface area than the individual tube sections alone. The connector may be made from a thermally conductive material. Accordingly, heat from the heated gas flowing through the two or more tube sections may be transferred to the connector. From the connector, the heat may be transferred to the contact surface of the casing of the refrigerator appliance. The heat may prevent a build up of condensation or other moisture, thus increasing the seal of the door and the casing and increasing the retention of cool air within the one or more chilled chambers.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the refrigerator appliance comprising:

a casing defining a contact surface, the casing at least partially forming a receiving space therein;

a door movable between an open position and a closed position, the door selectively abutting an outer face of the contact surface while in the closed position;

a sealed system comprising at least a first tube section and a second tube section, wherein the first tube section and the second tube section are positioned adjacent the contact surface; and a thermally conductive connector provided around the first tube section and the second tube section collectively, the thermally conductive connector adjoining the first tube section to the second tube section and forming a planar contact area abutting an inner face of the contact surface, wherein the thermally conductive connector comprises:

a metallic, continuous flat surface;

a first hooked edge bent from a top end of the continuous flat surface, the first hooked edge at least partially wrapping the first tube section radially outward from the first tube section; and a second hooked edge bent from a bottom end of the continuous flat surface, the second hooked edge at least partially wrapping the second tube section radially outward from the second tube section.

2. The refrigerator appliance of claim 1, wherein the casing defines a fresh food chamber and a freezing chamber, the fresh food chamber and the freezing chamber being separated by a mullion.

3. The refrigerator appliance of claim 2, wherein the first tube section and the second tube section are provided within the mullion.

4. The refrigerator appliance of claim 3, wherein the mullion extends along the lateral direction between the fresh food chamber and the freezing chamber.

5. The refrigerator appliance of claim 1, wherein the thermally conductive connector comprises a metallic tape wrapped around the first tube section and the second tube section together.

6. The refrigerator appliance of claim 5, wherein the metallic tape is a conductive aluminum tape configured to transfer heat between the first tube section and the second tube section and the contact surface.

7. The refrigerator appliance of claim 1, wherein the thermally conductive connector comprises a metallic clip that clips the first tube section to the second tube section.

8. The refrigerator appliance of claim 7, wherein the metallic clip is an aluminum clip configured to transfer heat between the first tube section and the second tube section and the contact surface.

9. The refrigerator appliance of claim 1, wherein the first tube section and the second tube section extend along the lateral direction and are arranged vertically with respect to one another.

10. The refrigerator appliance of claim 1, further comprising a spacer provided within the casing behind the thermally conductive connector away from the inner face of the contact surface, the spacer being capable of maintaining a contact of the thermally conductive connector with the inner face of the contact surface.

11. The refrigerator appliance of claim 10, wherein the spacer comprises at least one foam insert.

12. The refrigerator appliance of claim 1, wherein the thermally conductive connector extends between 50% and 75% of a length of the first tube section and the second tube section along the lateral direction.

13. The refrigerator appliance of claim 1, wherein the first hooked edge contacts the first tube section over at least half of a circumference thereof, and wherein the second hooked edge contacts the second tube section over at least half of a circumference thereof.

14. A refrigerator appliance defining a vertical direction, a lateral direction, and a transverse direction, the refrigerator appliance comprising:

a casing defining a contact surface, the casing at least partially forming a receiving space therein;

a door movable between an open position and a closed position, the door selectively abutting an outer face of the contact surface while in the closed position;

a sealed refrigerating system provided within the receiving space of the casing, the sealed refrigerating system comprising a hot fluid portion positioned adjacent the contact surface, wherein the hot fluid portion comprises a first tube section and a second tube section parallel to the first tube section; and a thermally conductive fin provided around the first tube section and the second tube section together, the thermally conductive fin forming a metallic, continuous planar contact area between the first tube section and the second tube section, the planar contact area abutting an inner face of the contact surface, wherein the thermally conductive fin comprises:

a first hooked edge bent from a top end of the continuous planar contact area, the first hooked edge at least partially wrapping the first tube section radially outward from the first tube section; and a second hooked edge bent from a bottom end of the continuous planar contact area, the second hooked edge at least partially wrapping the second tube section radially outward from the second tube section.

15. The refrigerator appliance of claim 14, wherein the casing defines a fresh food chamber and a freezing chamber, the fresh food chamber and the freezing chamber being separated by a mullion.

16. The refrigerator appliance of claim 15, wherein the hot fluid portion is provided within the mullion.

17. The refrigerator appliance of claim 16, wherein the mullion extends along the lateral direction between the fresh food chamber and the freezing chamber.

18. The refrigerator appliance of claim 14, wherein the thermally conductive fin is a metallic tape, and wherein the metallic tape is a conductive aluminum tape configured to transfer heat between the hot fluid portion and the contact surface.

19. The refrigerator appliance of claim 14, further comprising a spacer provided within the casing behind the thermally conductive connector away from the inner face of the contact surface, the spacer being capable of maintaining a contact of the thermally conductive continuous planar contact area with the inner face of the contact surface.

20. The refrigerator appliance of claim 14, wherein the thermally conductive tape extends between 50% and 75% of a length of the hot fluid portion along the lateral direction.

* * * * *